United States Patent [19]

Hazlehurst et al.

[11] 4,165,026

[45] Aug. 21, 1979

[54] TUNDISH WITH EXPENDABLE LINING AND EASILY REMOVABLE NOZZLE

[75] Inventors: Ian J. Hazlehurst; David C. Willard, both of Guelph, Canada

[73] Assignee: Foseco Trading A.G., Chur, Switzerland

[21] Appl. No.: 889,843

[22] Filed: Mar. 24, 1978

Related U.S. Application Data

[60] Division of Ser. No. 789,943, Apr. 22, 1977, which is a continuation of Ser. No. 312,274, Dec. 5, 1972, abandoned.

[30] Foreign Application Priority Data

Dec. 7, 1971 [GB] United Kingdom ..... 56878/71
Oct. 19, 1972 [GB] United Kingdom ..... 48249/72

[51] Int. Cl.[2] ..... B22D 41/02
[52] U.S. Cl. ..... 222/591; 222/607
[58] Field of Search ..... 222/590, 591, 567, 607; 164/335, 337; 264/30

[56] References Cited

U.S. PATENT DOCUMENTS 3,801,058 4/1974 Boto ..... 222/591 X

FOREIGN PATENT DOCUMENTS 932073 7/1956 United Kingdom ..... 222/607
969560 9/1964 United Kingdom ..... 222/591
1363855 8/1974 United Kingdom ..... 222/591

*Primary Examiner*—David A. Scherbel
*Attorney, Agent, or Firm*—Cushman, Darby & Cushman

[57] ABSTRACT

A tundish has a metal casing, an inner permanent lining, e.g. of refractory brick, an inner expendable lining within the permanent lining and formed of slabs of refractory heat-insulating material, and at least one nozzle including a highly refractory nozzle ring set into the base of the tundish by means of a sealing compound which remains unhardened during the use of the tundish for continuous casting of molten metal.

9 Claims, 2 Drawing Figures

TUNDISH WITH EXPENDABLE LINING AND EASILY REMOVABLE NOZZLE

Figure 1:
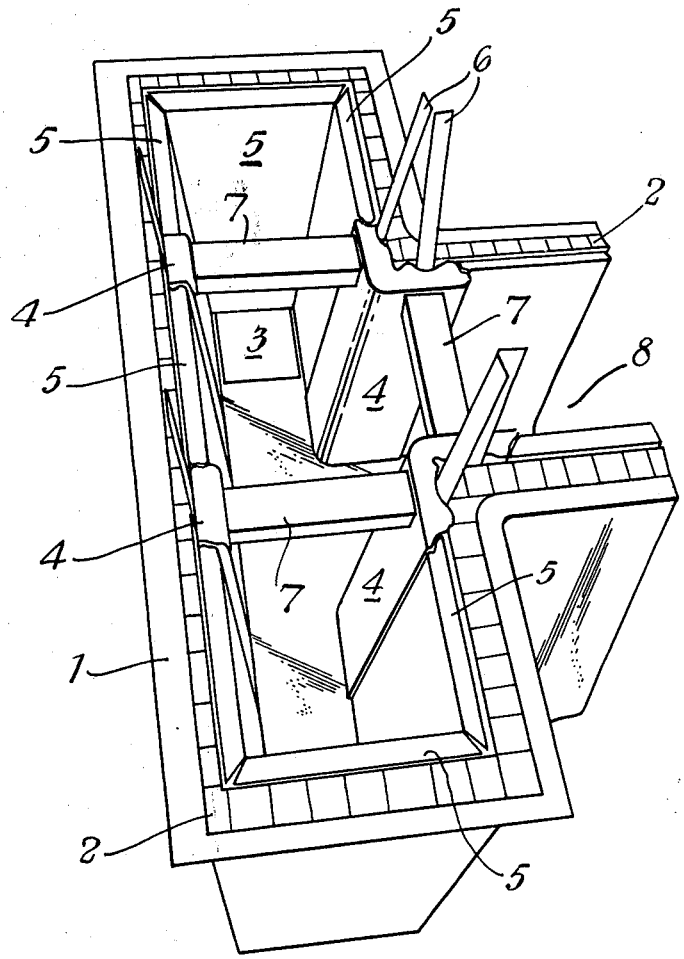

This is a division of application Ser. No. 789,943 filed Apr. 22, 1977, which in turn is a continuation of application Ser. No. 312,274 filed Dec. 5, 1972 and now abandoned, the entire specifications of which are hereby incorporated by reference.

This invention relates to tundishes.

In continuous casting, it is necessary to pour molten metal into a continuous casting mould at a substantially constant rate. This is achieved in practice by interposing between a ladle in which the molten metal is stored and the mould itself, a small vessel which acts as a constant head tank. This small vessel is called a tundish. As metal is poured from the tundish into the mould, the level is made up by the additions of molten metal from the ladle. It is also possible, using a tundish, to cast more than one ladleful of metal continuously, since the tundish acts as a molten metal reservoir.

The conditions encountered by the lining of a tundish when pouring for continuous casting are particularly arduous and more severe on the refractory lining than in many applications of refractory materials, since molten metal will be continuously passing through the tundish for long periods which may be up to several hours. It has heretofore been considered that only the use of refractory brick linings with their inherent high heat capacity will withstand the conditions encountered in such use. It is common practice to patch the tundish lining after each heat of metal, and to reline the tundish completely after 5–45 heats.

A further difficulty in the use of tundishes in continuous casting is the tendency to cooling of the molten metal when it is poured into the tundish at the start of a continuous casting run because of the high heat capacity of the refractory brick lining. In order to avoid metal solidifying and so causing blockages in the tundish it is common practice to pre-heat the tundish and tundish nozzles before use. Usually pre-heat time varies from 2 to 10 hours, the actual time depending on such factors as the availability of furnaces and whether any heats of metal need to be diverted due to their analysis being outside laid down specifications.

It may also be necessary to continue applying heat to the tundish during the actual casting process in order to prevent the molten metal from cooling to such a temperature where nozzle freeze-off will occur. Other commonly used methods for the prevention of heat loss include fitting a cover or lid over the tundish and covering the molten metal in the tundish with a layer of an exothermic and/or heat/insulating composition. Alternatively in the continuous casting of steel an exothermic reacting material e.g. calcium silicide may be placed in the tundish at the start of the casting process. The heat of solution of calcium silicide provides superheat to the initial metal entering the tundish.

Even if the precautions described above are adopted it may still happen that during the casting cycle there is excessive loss of temperature and consequent freeze-off of the tundish nozzles. In such circumstances any metal remaining in the ladle must be poured back into the furnace or diverted.

At the end of the casting cycle it is necessary to remove residual solidified metal or skull from the tundish, prior to patching the lining and replacing the tundish nozzles. The usual method for removing skull is known as lancing, and involves blowing an oxygen jet on to the residual hot metal in order to convert it into a fluid slag which may be readily removed. This practice produces large quantities of fume, is time consuming and therefore expensive in terms of labour costs, and it may cause extensive damage to the refractory brick tundish lining reducing its working life.

Another practice for removing skull involves the insertion of steel bars into the partially liquid skull. When the skull has solidified the bars are used to enable the skull to be removed by a crane or similar lifting gear.

American Metal Market, July 21, 1970, discloses a tundish having an extra inner lining of slabs of refractory material.

According to the present invention there is provided a tundish comprising an outer metal casing, a permanent lining or refractory material adjacent the casing and an expendable lining made up of a set of slabs of refractory heat insulating material, the impact area of the tundish being lined with highly erosion resistant or sacrificial material. The slabs may be jointed with refractory cement.

Preferably the area round the or each nozzle of the tundish is provided with a quantity of exothermically reactive mixture. This may be aluminothermic or based on, for example, calcium silicide.

Preferably also the permanent lining is coated with a refractory dressing. Between the permanent and expendable linings there may be situated several metal strips, e.g. steel tapes or wires for removing skull and burnt-out lining after the end of a casting cycle. Preferably, each nozzle in the base of the tundish is formed by a highly refractory ceramic nozzle ring set in an oversized aperture by means of a sealing compound which, during use of the tundish, does not harden to set the ring firmly in the tundish base.

The permanent refractory lining may be made of refractory bricks or may be a cast or rammed monolithic lining or a combination of the two.

The impact area, i.e. the area of the interior of the tundish where the molten metal stream entering the tundish exerts most erosive effects, may be lined or faced with erosion-resistant refractory such as high alumina refractory brick, magnesite brick or silicon carbide. Alternatively, it may be lined with a sufficient thickness of sacrificial material, e.g. a steel plate or slab.

The preferred thickness for the expendable lining is 5 to 100 mm, most preferably 12 to 50 mm, a thicker layer being more preferable as the thickness of the permanent lining decreases.

According to a further feature of the invention there is provided a method of continuous casting of molten metal, particularly molten steel, which comprises the use of a tundish as just defined.

In addition to having the required insulation properties the material chosen for the expendable lining in the tundish should not be readily wetted by molten metal, and should be frangible to allow easy removal at the end of a casting cycle. When molten steel is being continuously cast it is thought that the "non-wetting" property of the refractory heat insulating material is conferred as a result of carbonisation of organic constituents and sintering of inorganic constituents. These properties facilitate removal of metal skull at the end of the casting cycle, and eliminate the necessity for lancing with oxygen. Thus cleaning of the tundish after use is easier since the lining may simply be stripped out and replaced. In order to facilitate such stripping, metal straps may be located between the expendable lining and the permanent refractory linings.

Although it is not necessary to lance in order to remove metal skull a lancing technique may be adopted to remove the nozzles and clean the nozzle well areas. Alternatively, jacks placed against the exterior of the nozzles apply pressure forcing the nozzles and the tundish skull into the body of the tundish without damage to the primary brick lining.

It is found that when using tundishes of the type described it is wholly unnecessary to pre-heat more than the outlet nozzle area of the tundish, thus providing substantial savings in fuel and other economies.

The expendable lining of refractory heat insulating material of low thermal conductivity is of a plurality of pieces of slabs. A refractory cement is applied to the joints between slabs of slab section to minimise metal penetration to the permanent lining. Generally, refractory heat insulating slabs of low thermal conductivity are suitable for use as the expendable lining and are composed of refractory fibres (e.g. asbestos, calcium silicate, aluminium silicate fibre) refractory fillers (e.g. silica, alumina, magnesia, refractory silicates) and a binder (e.g. colloidal silica sol, sodium silicate, starch, phenol-formaldehyde resin, urea-formaldehyde resin).

When used with high melting point metal such as steel, the molten metal contacting surface of the expendable lining may be coated with a protective refractory dressing, for example, a suspension of zircon, fused silica, alumina, magnesite, chromite or chromium oxide in a liquid binder medium. It may also be advantageous to coat at least the floor of the permanent lining with a protective refractory dressing, to protect the permanent lining should the expendable lining fail in use.

In order to prevent damage of the lining due to splash and erosion at the begining of the casting cycle, refractory brick may be provided at the impact area, i.e. at the point of impingement of the molten metal stream into the tundish. The refractory brick may be, for example, 70% alumina brick and may be wedged into position on the top of the expendable tundish lining of the tundish.

Figure 2:
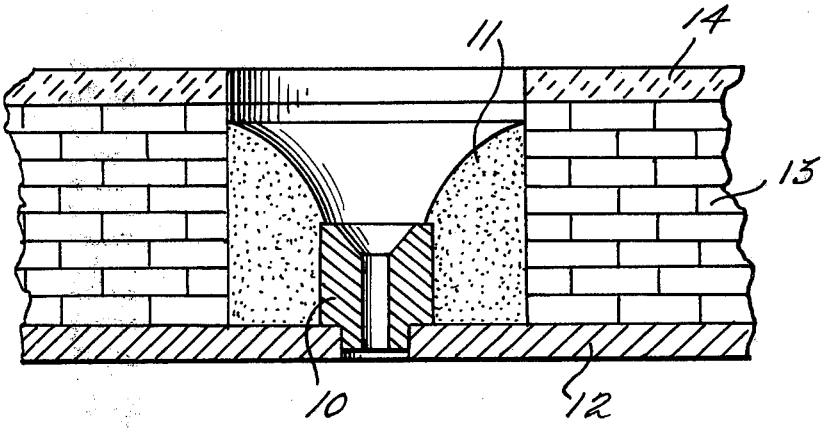

The invention is illustrated by way of example, in the accompanying drawings of which FIG. 1 shows a continuous casting tundish from above in perspective, and FIG. 2 shows in vertical section the nozzle portion of the tundish.

Referring to the drawing, the tundish of FIG. 1 consists of a metal casing 1 having a base and wall lined with refractory bricks 2. In the base are pouring nozzles 3.

The sides of the tundish are lined with an inner lining of preformed slabs 5 of refractory heat insulating material typically of density 0.75 gm/cc thickness 25 mm and thermal conductivity 0.0007 C.G.S. Units, though the density and thickness are not critical.

FIG. 2 shows in vertical section the nozzle portion of the tundish wherein the tundish base has a nozzle (10) set into it by means of a sealing composition (11) which does not harden. Elements (12), (13) and (14) represent the metal casing, permanent refractory lining and expendable lining, respectively.

The sequence of operations adopted for installing the lining was as follows:

The inside of the tundish was thoroughly cleaned such that the base and walls were relatively smooth and free from obstructions. The refractory brick lining was inspected for damage and where necessary refractory patching compound was applied. The upper face of the bricks 2 lining the floor was coated with a zircon-based dressing, and metal strips 6 were inserted against the refractory brick lining. Slabs 5 of heat insulating refractory material were then placed on the base of the tundish care being taken to ensure that the slabs were immediately adjacent to or slightly overlapped the wells of the nozzles such that no part of the refractory brick lining was exposed. The slabs were bonded together using a refractory cement. Slabs 4 and 5 for lining the vertical sides and ends of the tundish were installed and bonded in a similar way, the end slabs being wedged into position last, and the nozzles 3 were then set in position by means of a refractory ramming material. The nozzles were heated for 10–15 minutes immediately prior to pouring to remove any moisture. The slabs were held apart at the upper ends by pieces of scrap insulator 7.

The metal strips 6, which may be for example, 40 to 60 mm wide by 0.5 to 1 mm thick, allow easy removal of slabs 5 after use, e.g. by joining the upper ends of the strips 6 to form two loops and lifting these with a crane, so as to remove the used lining, skull and slag, together, leaving the brick lining undamaged and the tundish ready to receive a new inner lining. Normally, before joining the ends of the strips the linings would be loosened by oxygen lancing the nozzle wells.

An inflow runner 8 is provided at one side of the tundish. This runner may also be lined with the same, or a similar material as slabs 5. Slabs 4 and 5 are sealed together by a proprietary refractory cement. Any large gaps between the permanent and expendable linings may be filled e.g. by loose facing sand.

The refractory heat insulating material of slabs 5 has a composition of (by weight):

| | |
|---|---|
| Silica Flour | 76% |
| Urea Formaldehyde Resin | 1% |
| Phenol Formaldehyde Resin | 4% |
| Asbestos | 4% |
| Calcined Diatomite | 4% |
| Slag Wool | 11% |

During the casting operation an exothermic or insulating cover, e.g. a refractory powder may be applied to the surface of the molten metal in the tundish. The normal application rate for the insulating cover material is 450 g to 3.6 kg per tonne of metal cast depending on the tapping temperature of the metal and the grade of metal being produced. The cover should preferably be built up slowly during the first 10 minutes of casting, and further additions of cover material made as required throughout the casting operation. Too rapid addition of cover material may result in chilling of the molten metal.

It is to be noted that the type of construction illustrated in the accompanying drawing is particularly advantageous. The assembly of slabs 4 and 5 is modular, i.e. only a few sizes 4 and 5 are necessary for lining a wide range of tundish sizes. Furthermore, it should be noted that pieces 4 and 5 are of different thickness; this is so that the edges of pieces 4 may be rebated and so made to fit over the edges of slabs 5 without, in some cases, the necessity of applying sealing compound to seal the joint between them. This concept of modular assembly greatly facilitates the replacement of the expendable lining.

Use of a tundish according to the invention offers a number of advantages:

(1) In spite of the elimination or reduction of preheating there is little drop in the temperature of the molten metal on entering the tundish.

(2) When the permanent brick lining is of brick, the brick thickness may be reduced considerably.

(3) There is less need for repair of the permanent lining and the life of the permanent lining is extended.

(4) The use of a castable or other type of refractory dressing as a coating for the permanent lining may be eliminated.

(5) The casting temperature may be controlled more readily and due to the superior insulating characteristics of the lining cooler heats may be cast successfully with greater freedom from nozzle blockage due to premature solidification. It is possible to cast a complete heat on one strand or on a reduced number of strands when one or more nozzles are blocked up. The number of times in a given period when it would be necessary to return metal to the furnace is therefore reduced.

(6) There is less tendency for skull to be formed even after prolonged pouring thus increasing the yield of cast metal.

(7) When relining of the tundish is necessary the operation may be accomplished rapidly due to the use of prefabricated shapes and their easy removal. Tundish circulation rate is therefore increased and the total number of tundishes required reduced.

(8) The life of the metal tundish casing itself is extended.

(9) By choosing suitable lining compositions it is possible to operate the tundish for multiple continuous casting runs without relining.

(10) There is an overall improvement in the operation and handling of the tundish, and also in the working conditions in the vicinity of the tundish.

We claim as our invention:

1. A tundish consisting essentially of an outer metal casing, a permanent lining of refractory material adjacent the casing, an expendable lining made up of a set of slabs of refractory heat insulating material, and at least one nozzle including a highly refractory nozzle ring set into the base of the tundish by means of a sealing compound which remains unhardened during the use of the tundish for continuous casting of molten metal.

2. The tundish of claim 1 wherein said expendable liner is formed of a set of slabs of refractory heat insulating material having a known rate of consumability which is sufficiently long to complete a pour of molten metal.

3. The tundish of claim 2 said set of slabs conform in size with said inner wall and are in registry therewith.

4. The tundish of claim 1 wherein said permanent lining of refractory material is a refractory brick lining and said expendable liner slabs are positioned thereover.

5. The tundish of claim 1 wherein said permanent lining of refractory material is a monolithic refractory lining and said expendable liner slabs are positioned thereover.

6. The tundish of claim 1 wherein a quantity of exothermically reactive composition is provided in the region of each nozzle.

7. The tundish of claim 1 wherein a plurality of metal straps are located between said expendable lining and said permanent lining to facilitate stripping out the expendable lining.

8. The tundish of claim 1 wherein at least one of the linings is faced at least in part with a protective refractory dressing.

9. The tundish of claim 1 wherein the impact area of the tundish is lined with a material selected from the group consisting of high alumina brick, magnesite brick and silicon carbide.

* * * * *